US009608369B1

(12) United States Patent
Brandt et al.

(10) Patent No.: US 9,608,369 B1
(45) Date of Patent: Mar. 28, 2017

(54) CONNECTOR SYSTEM WITH CONNECTOR POSITION ASSURANCE

(71) Applicant: TYCO ELECTRONICS CORPORATION, Berwyn, PA (US)

(72) Inventors: Christian Perry Brandt, York, PA (US); Neil Franklin Schroll, Mount Joy, PA (US)

(73) Assignee: TE CONNECTIVITY CORPORATION

( * ) Notice: Subject to any disclaimer, the term of this patent is extended or adjusted under 35 U.S.C. 154(b) by 0 days.

(21) Appl. No.: 15/149,616

(22) Filed: May 9, 2016

(51) Int. Cl.

| | |
|---|---|
| ***H01R 13/629*** | (2006.01) |
| ***H01R 12/75*** | (2011.01) |
| ***H01R 13/11*** | (2006.01) |
| ***H01R 13/64*** | (2006.01) |

(52) U.S. Cl.
CPC ..... *H01R 13/62955* (2013.01); *H01R 12/75* (2013.01); *H01R 13/111* (2013.01); *H01R 13/64* (2013.01)

(58) Field of Classification Search
CPC ..... H01R 13/629; H01R 13/62933
USPC ..... 439/352
See application file for complete search history.

(56) References Cited

U.S. PATENT DOCUMENTS

| | | | | |
|---|---|---|---|---|
| 6,077,101 | A * | 6/2000 | Garretson | H01R 13/627 439/352 |
| 8,137,142 | B1 * | 3/2012 | Dawson | H01R 13/639 439/676 |
| 2010/0233897 | A1 * | 9/2010 | Seo | H01R 13/6272 439/345 |
| 2014/0242823 | A1 * | 8/2014 | Littek | H01R 13/422 439/162 |
| 2014/0248475 | A1 * | 9/2014 | Kasai | C08F 226/06 428/201 |
| 2015/0093927 | A1 * | 4/2015 | Morello | H01R 13/641 439/352 |

* cited by examiner

*Primary Examiner* — Gary Paumen

(57) ABSTRACT

A connector system includes an electrical connector that has a housing, a rounded member, and a connector position assurance (CPA) lever. The housing defines a cavity that receives a mating connector and a socket that holds the rounded member therein. The rounded member is moved by the mating connector from a seated position to a lifted position, and attains the lifted position when the mating connector is fully loaded in the cavity. The CPA lever is slidable relative to the housing between an extended position and a retracted position. When the rounded member is in the seated position, a protrusion on the housing blocks movement of the CPA lever from the extended position to the retracted position. When the rounded member is in the lifted position, the rounded member deflects the deflectable tab to clear the protrusion, allowing the CPA lever to be moved to the retracted position.

20 Claims, 5 Drawing Sheets

CONNECTOR SYSTEM WITH CONNECTOR POSITION ASSURANCE

BACKGROUND OF THE INVENTION

The subject matter herein relates generally to connector systems, and more specifically to connector systems that provide connector position assurance.

In some connector systems, a coupling mechanism is used when a first connector is mated to a second connector to secure the first and second connectors together. The first and second connectors are secured together to ensure that the connector system can withstand forces that would tend to pull the connectors apart and break the conductive pathway that is formed between the connectors when mated to each other. In some embodiments, the coupling mechanism is defined by a latch on one connector that engages a catch of a mating connector when the two connectors are fully mated.

Ensuring that the mated connectors in a respective connector system are fully mated to one another may avoid operating errors due to breaks in the conductive pathway that occur when the connectors are not fully mated to each other. The connector system may be used in a complex manufactured product, such as an automobile. If the connectors in the connector system are not fully mated to each other during assembly of the automobile, an eventual error caused by the break in the conductive pathway may be difficult to discover and/or remedy. For example, it may be difficult to identify and access a faulty connection between two connectors in the automobile that includes hundreds or thousands of connections.

Due to physical characteristics such as small size and shielded conductors, it may be difficult for a worker (or even a machine) to accurately recognize whether two mating connectors are fully mated together at an assembly facility. For example, two connectors that are not fully mated to each other may only be a few millimeters off from the fully mated positions of the connectors, which may be difficult for the worker and/or the machine to identify. A need remains for a connector system that provides assurance that two connectors are fully mated to each other in order to avoid errors caused by breaks in the conductive pathway defined by the connectors.

BRIEF DESCRIPTION OF THE INVENTION

In an embodiment, an electrical connector is provided that includes a housing, a rounded member, and a connector position assurance (CPA) lever. The housing has a front end and defines a cavity at the front end that is configured to receive a mating connector therein. The housing further defines a socket adjacent to the cavity that is at least partially open to the cavity. The housing includes at least a first protrusion proximate to the socket that defines a hard stop surface. The rounded member is held in the socket of the housing and is movable relative to the housing between a seated position and a lifted position. The rounded member is biased towards the seated position and is configured to be moved from the seated position to the lifted position by the mating connector as the mating connector is loaded into the cavity. The rounded member attains the lifted position as the mating connector reaches a fully mated position in the cavity. The CPA lever is mounted on the housing and is slidable relative to the housing between an extended position and a retracted position. The CPA lever includes a base and a deflectable tab extending from the base. When the rounded member is in the seated position, movement of the CPA lever from the extended position to the retracted position is mechanically blocked by the hard stop surface of the first protrusion that abuts the deflectable tab. When the rounded member is in the lifted position, the rounded member engages and deflects the deflectable tab to a clearance position that clears the first protrusion allowing the CPA lever to be moved from the extended position to the retracted position.

In an embodiment, an electrical connector is provided that includes a housing, a rounded member, and a connector position assurance (CPA) lever. The housing has a front end and defines a cavity at the front end that is configured to receive a mating connector therein. The housing further defines a socket adjacent to the cavity and at least partially open to the cavity. The housing includes a deflectable primary latch that engages a catch of the mating connector when the mating connector is in a fully mated position in the cavity to secure the mating connector to the housing. The primary latch has at least a first protrusion that defines a hard stop surface. The rounded member is held in the socket of the housing and is movable relative to the housing between a seated position and a lifted position. The rounded member is biased towards the seated position and is configured to be moved from the seated position to the lifted position by the mating connector as the mating connector is loaded into the cavity. The rounded member attains the lifted position as the mating connector reaches the fully mated position. The CPA lever is mounted on the primary latch and is slidable relative to the primary latch between an extended position and a retracted position. The CPA lever includes a base and a deflectable tab extending from the base. When the rounded member is in the seated position, movement of the CPA lever from the extended position to the retracted position is mechanically blocked by the hard stop surface of the first protrusion that abuts the deflectable tab. When the rounded member is in the lifted position, the rounded member engages and deflects the deflectable tab to a clearance position that clears the first protrusion allowing the CPA lever to be moved from the extended position to the retracted position.

DETAILED DESCRIPTION OF THE INVENTION

One or more embodiments described herein provide a connector system having an electrical connector that includes a connector position assurance (CPA) lever. The CPA lever is movable between an extended position and a retracted position. For example, the CPA lever can be moved back and forth between the extended position and the retracted position. The CPA lever in the extended position projects outward from a housing of the electrical connector and functions as a lever. The lever is used to lift a primary latch of the housing, such as to release the primary latch from a catch of a mating connector to disconnect the connectors or to provide clearance for the catch of the mating connector when connecting the two connectors. The CPA lever in the extended position extends outward from the housing to provide leverage for lifting the primary latch, reducing the force required to lift the primary latch relative to other mechanisms that do not have levers projecting from the housing. The CPA lever is stowable by moving the CPA lever to the retracted position. In the retracted position, the CPA lever does not project as far from the housing as the CPA lever does in the extended position. Thus, the electrical connector when the lever is in the retracted position is more compact and may provide more room for electrical cables and other components and devices in a crowded electrical environment.

In embodiments described herein, the CPA lever is configured to only be movable from the extended position to the retracted position in response to the mating electrical connector attaining a fully mated position relative to the housing of the electrical connector. Thus, the CPA lever is restricted from moving to the retracted position until the mating electrical connector is fully mated with the electrical connector, and the CPA lever is unrestricted or allowed to move to the retracted position once the mating connector is fully mated. The CPA lever is used as a connector position assurance mechanism to verify that the electrical connectors are fully mated by providing sensory (for example, tactile, visual, audible, etc.) feedback to a worker or a robotic machine assembling the connector system.

Figure 1:
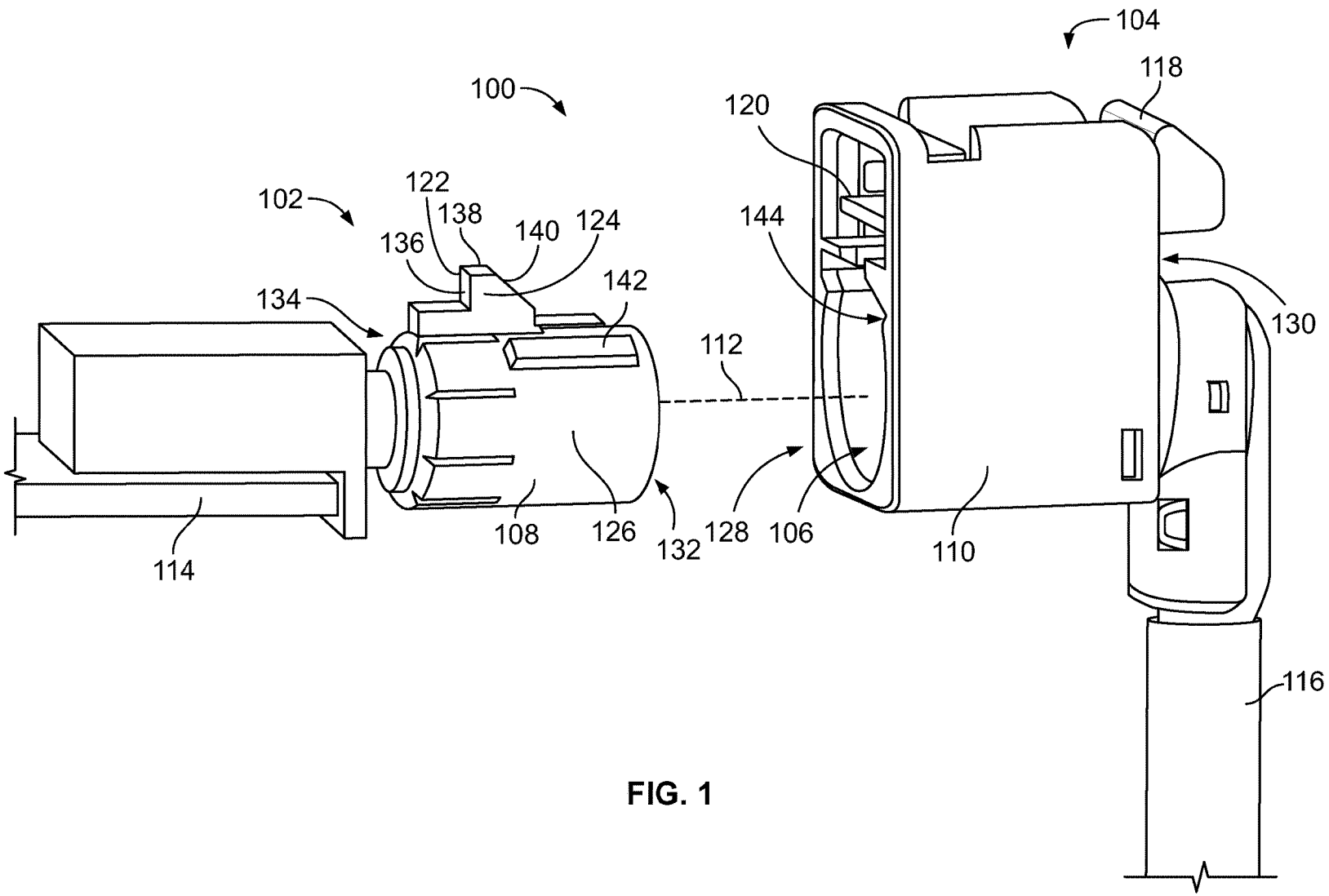
FIG. 1 is a perspective view of a connector system formed in accordance with an embodiment.

FIG. 1 is a perspective view of a connector system 100 formed in accordance with an embodiment. The connector system 100 includes a first electrical connector 102 and a second electrical connector 104. In the illustrated embodiment, the first electrical connector 102 is a male connector, and the second electrical connector 104 is a female connector, such that a portion of the first electrical connector 102 is received within a cavity 106 of the second electrical connector 104 during a mating operation. More specifically, a male housing 108 (e.g., a nose cone) of the first connector 102 is received within the cavity 106 defined by a female housing 110 of the second connector 104. Although shown as un-mated in FIG. 1, the first and second connectors 102, 104 are poised for mating along a mating axis 112. As used herein, the first electrical connector 102 is referred to as male connector 102 or mating connector 102, and the second electrical connector 104 is referred to as female connector 104 or simply as connector 104.

The connector system 100 may be used in numerous applications across various industries, such as the automotive industry, the home appliance industry, the aviation industry, and the like, to electrically couple two or more devices and/or electrical components. For example, in the automotive industry, the electrical connectors 102, 104 may be used for radio frequency communications, such as to electrically connect an antenna to a controller and/or processing device.

The male connector 102 and the female connector 104 each electrically connect to different electrical components and provide a conductive pathway between the corresponding electrical components. In the illustrated embodiment, the male connector 102 is edge-mounted on a printed circuit board 114, and the female connector 104 is electrically connected to a conductive cable or wire 116, such as a coaxial cable. In an alternative embodiment, the female connector 104 may be mounted to a circuit board and/or the male connector 102 may be terminated to a cable. The printed circuit board 114 and the cable 116 are each electrically terminated (e.g., crimped, soldered, etc.) to electrical contacts (not shown) of the respective connectors 102, 104 that engage each other when the connectors 102, 104 are mated. Various electrical signals conveying power, control, data, or the like, may be transmitted through the connectors 102, 104 between the printed circuit board 114 and the cable 116.

The female connector 104 has a right angle shape, although the angle defined by the female connector 104 need not be approximately 90°. For example, the mating axis 112 along which the male connector 102 is loaded into the cavity 106 is generally perpendicular to the orientation of the cable 116 exiting the female connector 104. Due to the right angle shape, the female connector 104 has a limited length along the mating axis 112. Thus, there is limited area available along the length for installing a conventional CPA device used to verify whether the male connector 102 and the female connector 104 are fully mated during a mating operation.

The female housing 110 of the female connector 104 extends between a front end 128 and a rear end 130. The front end 128 is a mating end that faces the male connector 102. The cavity 106 extends at least partially through the female housing 110 between the front end 128 and the rear end 130. The cavity 106 is open at the front end 128. The female connector 104 includes a CPA lever 118 that is mounted on the female housing 110. The CPA lever 118 is disposed radially outward of the cavity 106, as opposed to being located in or in-line with the cavity 106. In the illustrated embodiment, the CPA lever 118 is disposed above the cavity 106. The CPA lever 118 is operably coupled to a deflectable primary latch 120 of the female housing 110. The primary latch 120 is configured to engage a catch 122 of the male connector 102 to secure the female housing 110 to the male connector 102. The engagement between the primary latch 120 and the catch 122 is designed to absorb and withstand forces incidental to normal use that pull the connectors 102, 104 apart. The primary latch 120 is configured to deflect radially outward relative to the cavity 106. The primary latch 120 may deflect responsive to engagement with the male housing 108 as the male connector 102 is loaded into the cavity 106. Additionally, or alternatively, the primary latch 120 may deflect due to pivoting or rotation of the CPA lever 118, as described in more detail below.

The male housing 108 extends between a mating end 132 and a back end 134. The male housing 108 is loaded in the cavity 106 such that the mating end 132 is received first in the cavity 106, and the back end 134 may or may not enter the cavity 106. In the illustrated embodiment, the male housing 108 is a nose cone that has a generally cylindrical shape. The male housing 108 includes a rib 124 that projects from an outer surface 126 thereof. The rib 124 is configured to engage the primary latch 120. The rib 124 includes a catch surface 136 that defines the catch 122. The catch surface 136 faces the back end 134. The rib 124 may deflect the primary latch 120 as the male connector 102 is loaded. For example, a top side 138 of the rib 124 may define a ramp 140 that engages and gradually increases the deflection of the primary latch 120 as the male connector 102 moves along the mating axis 112 towards a fully loaded position. In the fully loaded position, the catch surface 136 of the rib 124 engages the primary latch 120 of the female housing 110 to secure the male connector 102 to the female connector 104. The male housing 108 optionally may include at least one keying ridge 142 that projects from the outer surface 126. Each keying ridge 142 is configured to be received in a corresponding key groove 144 along a periphery of the cavity 106 to ensure that the male housing 108 properly aligns with the female housing 110 during mating.

Optionally, the male and female connectors 102, 104 in the connector system 100 may be standardized connectors, such as FAKRA standardized connectors. FAKRA is the Automotive Standards Committee in the German Institute for Standardization, representing international standardization interests in the automotive field. The FAKRA standard provides a system, based on keying and color coding, for proper connector attachment. For example, the keying ridges 142 of the male housing 108 and the key grooves 144 on the female housing 110 may be features designed according to desired FAKRA specifications for restricting the mate-ability of each of the connectors 102, 104 to one or more specific mating connectors.

Figure 2:
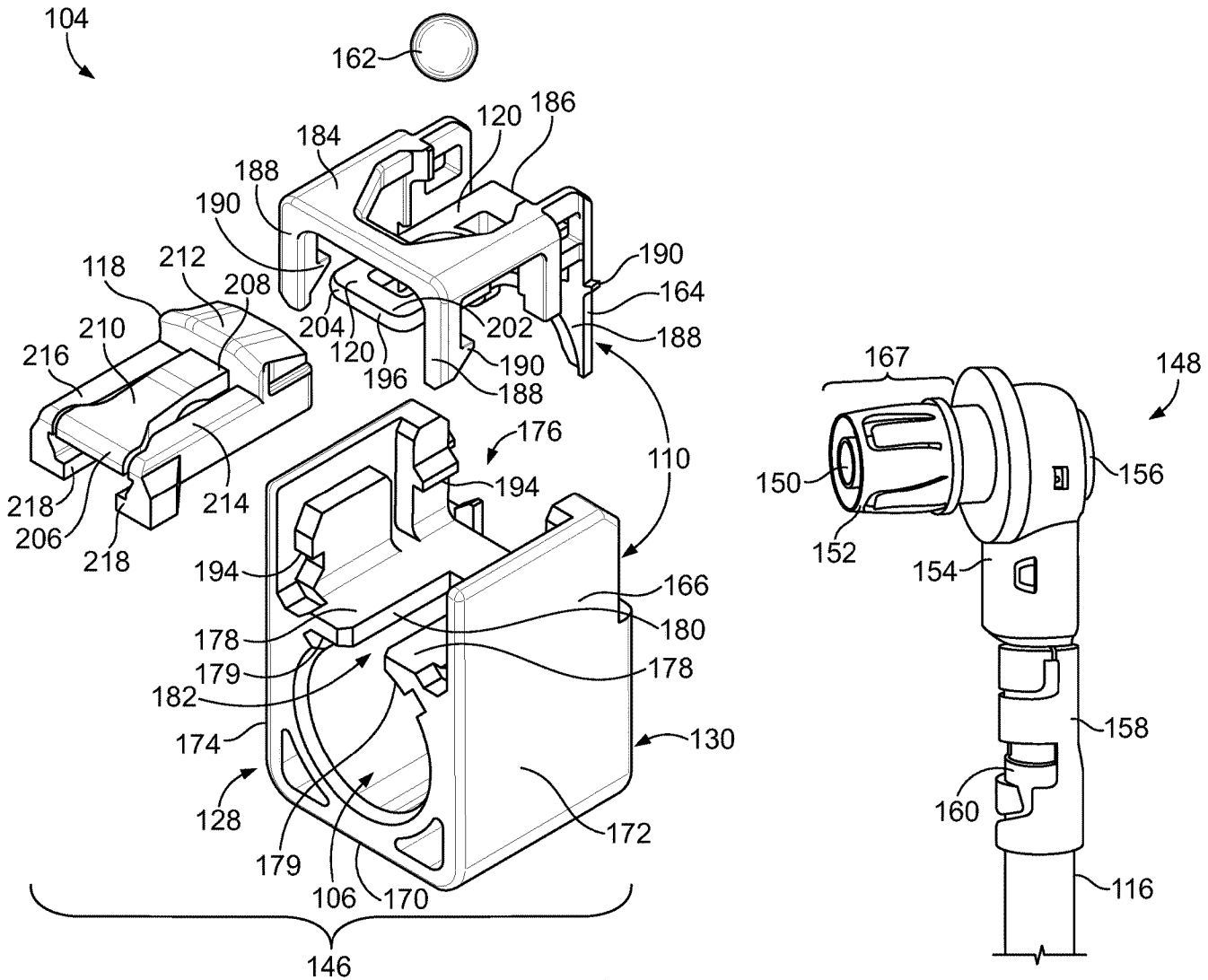
FIG. 2 is a partially exploded view of a female connector of the connector system according to an embodiment.

FIG. 2 is a partially exploded view of the female connector 104 according to an embodiment. The female connector 104 includes a housing assembly 146 and a contact assembly 148. In the illustrated embodiment, the housing assembly 146 is exploded, and the contact assembly 148 is intact. The housing assembly 146 includes the female housing 110, the CPA lever 118, and a rounded member 162. In an embodiment, the housing 110 is defined by an upper housing member 164 and a lower housing member 166 that couple together. The upper housing member 164 includes the primary latch 120. The lower housing member 166 defines the cavity 106. In an alternative embodiment, the housing 110 may be formed as a single, unitary component instead of an assembly of multiple discrete members.

The contact assembly 148 may be a coaxial contact assembly including a center contact (not shown), a dielectric 150 surrounding the center contact, and an outer contact 152 surrounding the dielectric 150. The contact assembly 148 also includes a front shield 154 and a rear shield 156. The dielectric 150 provides insulation between the center contact and the outer contact 152. The front and rear shields 154, 156 are electrically conductive and provide shielding to reduce electromagnetic interference such as cross-talk that could degrade the signal quality of the signals transmitted through the connector 104. The contact assembly 148 is terminated to the cable 116 by a ferrule 158 that is crimped around the front and rear shields 154, 156 and an outer jacket 160 of the cable 116. The ferrule 158 may also be crimped around a cable braid (not shown) of the cable 116.

The connector 104 is assembled by inserting a contact segment 167 of the contact assembly 148 into the female housing 110 through the rear end 130. The contact segment 167 includes the center contact, the dielectric 150, and the outer contact 152. The contact segment 167 is configured to engage corresponding components of the male connector 102 (shown in FIG. 1) to electrically connect the connectors 102, 104 when the male connector 102 is loaded into the cavity 106. An optional retainer clip (not shown) may be inserted into the female housing 110 subsequent to the contact segment 167 in order to secure the contact assembly 148 to the housing 110.

The compositions and details of the housing 110, the CPA lever 118, and the rounded member 162 are individually described below. The interoperability of the components will be explained with reference to succeeding figures. In an embodiment, the upper and lower housing members 164, 166 of the housing 110 and the CPA lever 118 are composed of one or more dielectric materials, such as plastics, such that the housing members 164, 166 and the CPA lever 118 are electrically insulative. The one or more dielectric materials of the housing members 164, 166, and the CPA lever 118 need not be the same. The housing members 164, 166 and the CPA lever 118 may be formed via molding processes, such as injection molding. In an alternative embodiment, the upper housing member 164, the lower housing member 166, and/or the CPA lever 118 may be formed at least partially of a conductive metal material.

The rounded member 162 in an embodiment is composed of a conductive metal material, such as aluminum, copper, silver, or an alloy containing at least one of aluminum, copper, or silver. Alternatively, the rounded member 162 may be composed of a dielectric material, such as one or more plastics. The rounded member 162 is at least partially round. For example, the rounded member 162 may be spherical or oblong. In the illustrated embodiment, the rounded member 162 is a spherical ball. The spherical ball may be hollow or solid. Optionally, the spherical ball may be a bearing ball, such as for use in a ball bearing. In an alternative embodiment, the rounded member 162 may have other rounded shapes than a sphere, such as an ovoid, a cylinder with rounded ends, an egg-shape, or the like.

The lower housing member 166 includes a bottom wall 170, a first side wall 172, and an opposite second side wall 174. A top end 176 of the lower housing member 166 is at least partially open. As used herein, relative or spatial terms such as "top," "bottom," "front," "rear," "first," and "second" are only used to distinguish the referenced elements of the female connector 104 and do not require particular positions or orientations relative to the direction of gravity and/or relative to the surrounding environment of the female connector 104, including the male connector 102 (shown in FIG. 1). The upper housing member 164 is configured to couple to the lower housing member 166 through the top end 176 above the cavity 106. The lower housing member 166 further includes a platform 180 that at least partially defines the cavity 106. The platform 180 is disposed between the cavity 106 and the upper housing member 164 when the upper housing member 164 is coupled to the lower housing member 166. The platform 180 includes a top side 178 and a bottom side 179. The top side 178 faces the top end 176 of the lower housing member 166, and the bottom side 179 defines a portion of the cavity 106. The platform 180 in the illustrated embodiment defines a channel 182 that extends vertically through the platform 180 between the top side 178 and the bottom side 179. The channel 182 extends longitudinally rearward from the front end 128 of the lower housing member 166. The channel 182 is configured to accommodate the rib 124 (shown in FIG. 1) of the male housing 108 (FIG. 1) therein as the male housing 108 enters the cavity 106.

The upper housing member 164 includes the primary latch 120 and a frame 184 that is connected to a fixed end 186 of the primary latch 120. The frame 184 supports the primary latch 120 and couples to the lower housing member 166. For example, the frame 184 may include mounting legs 188 having retention barbs 190 configured to engage and hook onto complementary catches 194 on the lower housing member 166 to couple the upper and lower housing members 164, 166 together. The primary latch 120 is cantilevered such that the fixed end 186 is connected to the frame 184 but an opposite distal or free end 196 of the primary latch 120 does not engage the frame 184. The primary latch 120 has a top side 202 and an opposite bottom side 204. The bottom side 204 faces the cavity 106 when the housing 110 is assembled.

The CPA lever 118 includes a base 212 and a deflectable tab 210 extending from the base 212. The base 212 is a bulbous, knob-like structure that may be at least partially curved. The large, curved structure of the base 212 provides a place of contact for an operator to grip and/or hold the CPA lever 118 in order to actuate (for example, slide and/or pivot) the CPA lever 118, as described in more detail herein. The deflectable tab 210 is cantilevered such that the tab 210 includes a fixed end 208 connected to the base 212 and a distal, free end 206 that does not engage the base 212 or any other part of the CPA lever 118 in a resting or unbiased position of the tab 210.

In an embodiment, the CPA lever 118 also includes first and second runners 214, 216 extending from the base 212. The runners 214, 216 have similar, if not identical, shapes that mirror each other. The runners 214, 216 extend generally parallel to one another and in the same general direction from the base 212 as the deflectable tab 210. The first and second runners 214, 216 are spaced apart from each other to straddle the primary latch 120 when mounted to the upper housing member 164. The deflectable tab 210 extends in a space between the first and second runners 214, 216. In an embodiment, the deflectable tab 210 does not engage either of the runners 214, 216. At least a portion of one or both runners 214, 216 extends towards the other runner 214, 216 under the primary latch 120 (e.g., between the primary latch 120 and the platform 180). In the illustrated embodiment, the first and second runners 214, 216 each include a respective ledge or lip 218 that extends towards the other runner 214, 216 under the primary latch 120. The ledges 218 are configured to engage the bottom side 204 of the primary latch 120 to lift and deflect the primary latch 120 when the CPA lever 118 is pivoted, as described herein. Although the illustrated embodiment shows two ledges 218, in an alternative embodiment the ledges 218 may be joined to one another such that a single ledge extending under the primary latch 120 connects the first and second runners 214, 216.

Figure 3:
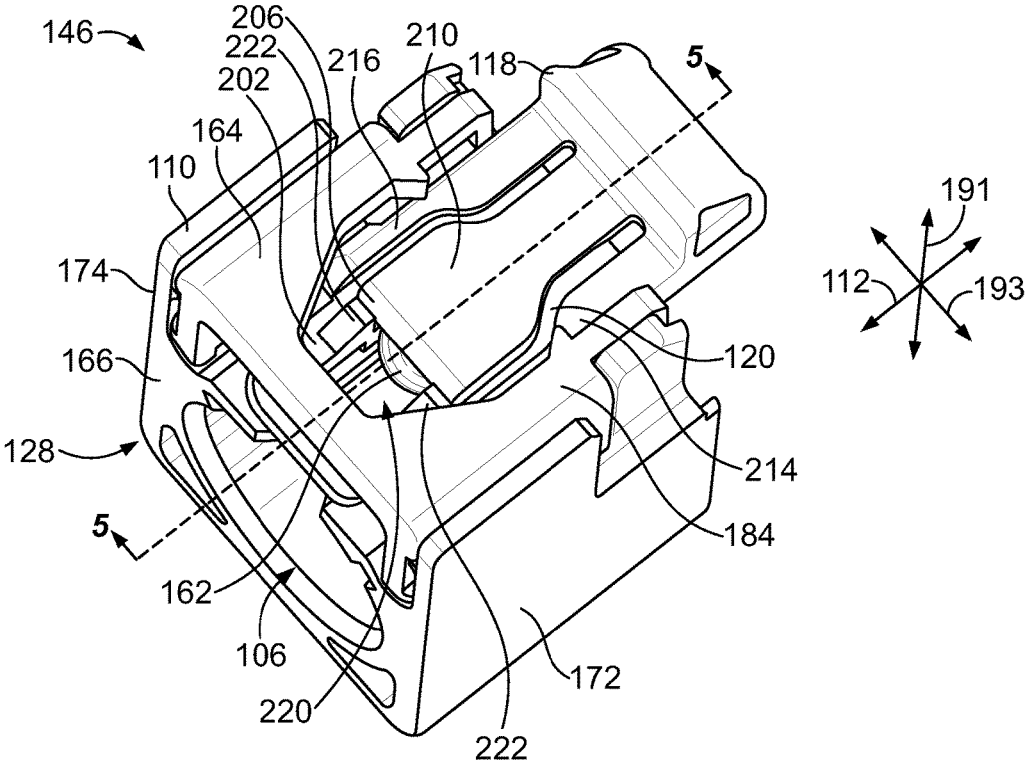
FIG. 3 is a top perspective view of a housing assembly of the female connector in an assembled state according to an embodiment.

FIG. 3 is a top perspective view of the housing assembly 146 in an assembled state according to an embodiment. The upper housing member 164 is coupled to the lower housing member 166 to define the assembled housing 110. The CPA lever 118 is mounted to the housing 110, and the rounded member 162 is held by the housing 110. The housing assembly 146 is oriented with respect to a vertical or elevation axis 191, a lateral axis 193, and the mating axis 112. The axes 191, 193, 112 are mutually perpendicular. Although the elevation axis 191 appears to extend in a generally parallel to gravity, it is understood that the axes 191, 193, 112 are not required to have any particular orientation with respect to gravity.

The primary latch 120 is generally centrally located between the first and second side walls 172, 174 of the housing 110 along the lateral axis 193. The CPA lever 118 may be mounted directly to the primary latch 120. The first and second runners 214, 216 of the CPA lever 118 straddle the primary latch 120. For example, the first runner 214 extends between the primary latch 120 and the first side wall 172, and the second runner 216 extends between the primary latch 120 and the second side wall 174. The deflectable tab 210 of the CPA lever 118 is disposed above the primary latch 120 along the vertical axis 191. The deflectable tab 210 may engage the top side 202 of the primary latch 120. In an embodiment, the primary latch 120 defines an aperture 220 that extends vertically through the latch 120 between the top side 202 and the bottom side 204 (shown in FIG. 2). The aperture 220 is elongated along the mating axis 112. The rounded member 162 is visible in FIG. 3 through the aperture 220. The rounded member 162 may be held at least partially within the aperture 220 of the primary latch 120. The rounded member 162 is located at least partially under the deflectable tab 210 of the CPA lever 118.

Figure 7:
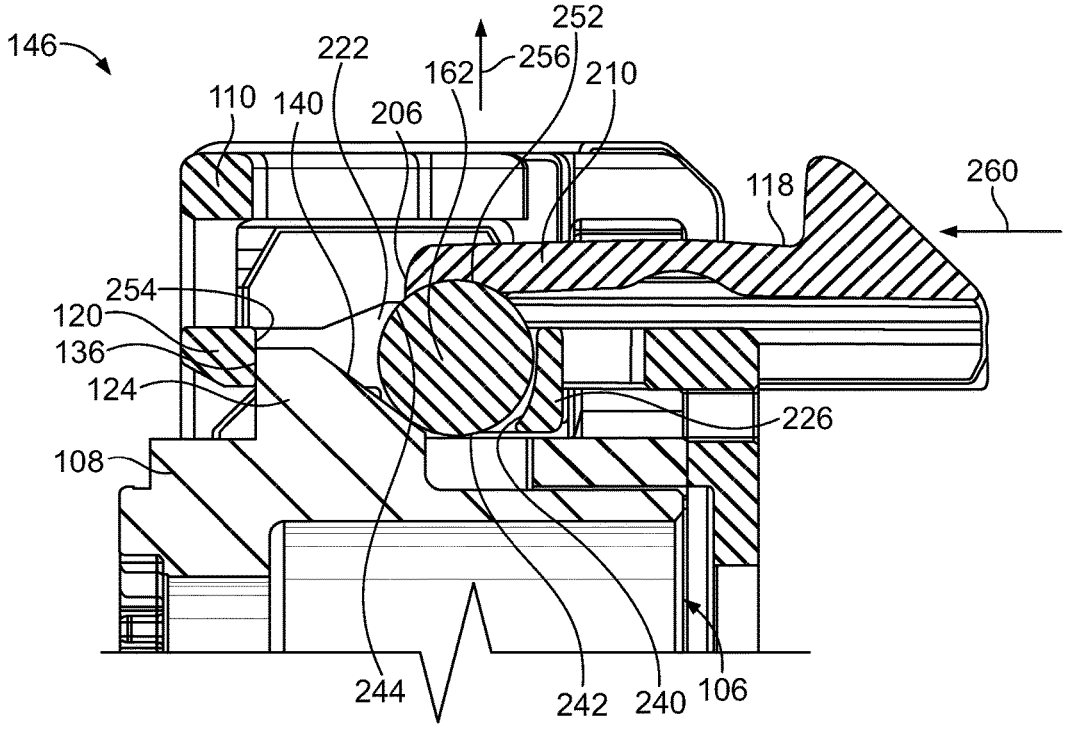
FIG. 7 is a cross-sectional view of a portion of the housing assembly in an initial mated stage taken along line 5-5 shown in FIG. 3.
Figure 8:
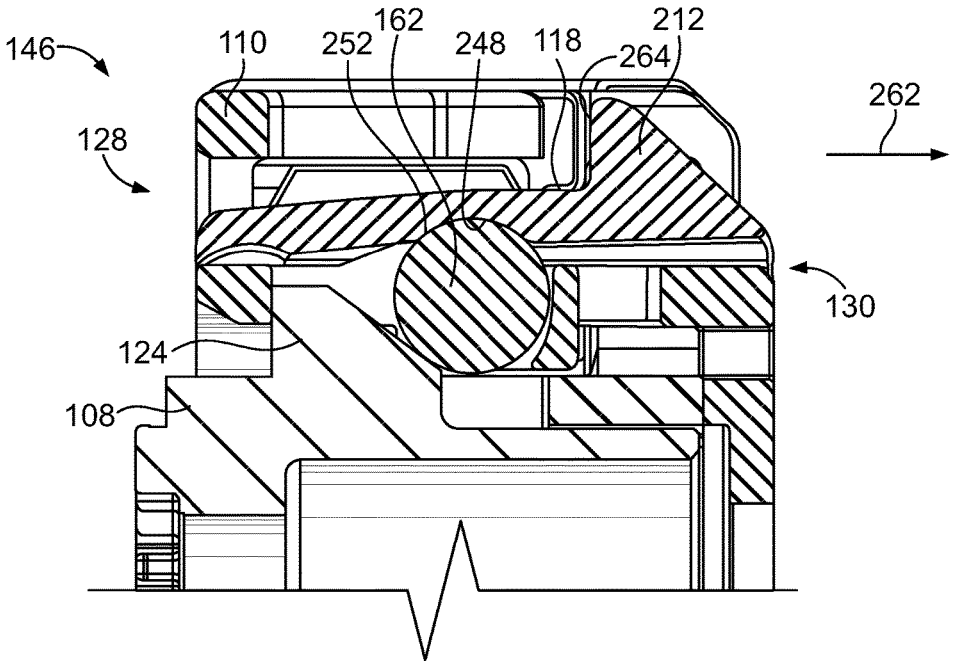
FIG. 8 is a cross-sectional view of a portion of the housing assembly in a final mated stage taken along line 5-5 shown in FIG. 3.

The CPA lever 118 is movable relative to the housing 110 between an extended position (depicted in FIGS. 5-7) and a retracted position (depicted in FIG. 8). The CPA lever 118 is shown in the extended position in FIG. 3. The CPA lever 118 is configured to move along the mating axis 112 between the extended and retracted positions. The runners 214, 216 of the CPA lever 118 may slide along the platform 180 and/or along the length of the primary latch 120 during the movement. The CPA lever 118 is moved via operator involvement, such as by an operator pushing or pulling the base 212 relative to the housing 110.

In an embodiment, the primary latch 120 defines at least one protrusion 222 that extends outward from a surface of the primary latch 120 to block movement of the CPA lever 118. In the illustrated embodiment, the primary latch 120 includes two protrusions 222 along the top side 202 that extend vertically upward (e.g., in a direction away from the cavity 106). The protrusions 222 are configured to abut the distal end 206 of the deflectable tab 210 to block movement of the CPA lever 118 from the extended position to the retracted position. Although the primary latch 120 defines the protrusions 222 in the illustrated embodiment, in an alternative embodiment, the frame 184 or other parts of the housing 110 may define protrusions that extend in the path of the CPA lever 118 to block movement of the CPA lever 118 to the retracted position.

Figure 4:
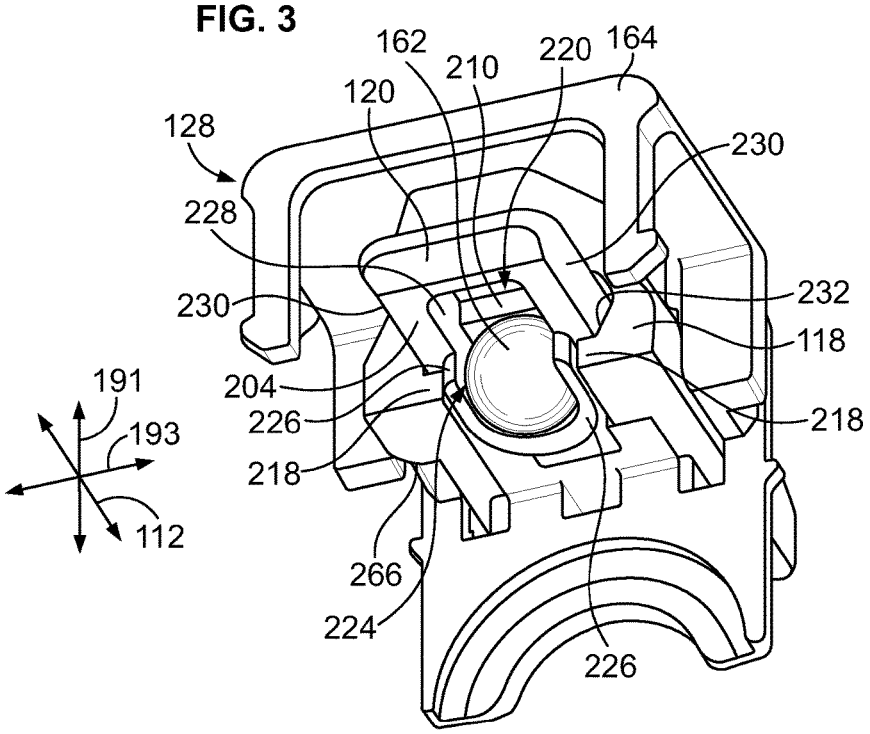
FIG. 4 is a bottom perspective view of an upper housing member, a CPA lever, and a rounded member of the housing assembly according to an embodiment.

FIG. 4 is a bottom perspective view of the upper housing member 164, the CPA lever 118, and the rounded member 162 of the housing assembly 146 shown in FIG. 3. The lower housing member 166 (shown in FIG. 3) is not depicted in FIG. 4. In an embodiment, the rounded member 162 is held in a socket 224 of the housing member 164. The socket 224 is at least partially defined by a collar 226 that protrudes from the bottom side 204 of the CPA lever 118. The socket 224 may also be partially defined by inner surfaces 228 of the primary latch 120 that define the aperture 220. The collar 226 surrounds a portion of the rounded member 162, such as a majority of the circumference or periphery of the rounded member 162. The collar 226 is open along a front portion that faces the front end 128 of the housing member 164, such that the collar 226 does not surround a front segment of the rounded member 162 facing the front end 128. The collar 226 may resemble a horseshoe shape. In an embodiment, the collar 226 is sized to receive the rounded member 162 in the socket 224 such that the rounded member 162 cannot fall downwards through the collar 226 along the vertical axis 191 towards the cavity 106 (shown in FIG. 3) or out of the collar 226 along a plane defined by the mating axis 112 and the lateral axis 193. In an embodiment, the deflectable tab 210 may extend over the socket 224 to function as a lid that prevents the rounded member 162 from exiting the socket 224 vertically upwards. Thus, the rounded member 162 is retained within the socket 224.

The socket 224 is sized with some clearance to allow the rounded member 162 to move between a seated position and a lifted position relative to the housing member 164. In the illustrated embodiment, the rounded member 162 is shown in the seated position. The rounded member 162 may be moved vertically upwards along the vertical axis 191 to attain the lifted position. Optionally, the rounded member 162 may also move laterally between the seated and lifted positions as defined by the constraints of the socket 224, such that the rounded member 162 may not only move along the vertical axis 191. The rounded member 162 is biased towards the seated position. For example, the rounded member 162 may be biased in the seated position via the force of gravity. Optionally, a spring or another compressive member may be configured to apply a biasing force on the rounded member 162 towards the seated position to bias the rounded member 162 in the seated position such that the rounded member 162 returns to the seated position when the rounded member 162 is not engaged by the mating connector 102 (shown in FIG. 1).

FIG. 4 also shows the engagement between the first and second runners 214, 216 and the primary latch 120. For example, the runners 214, 216, border corresponding edge sides 230 of the primary latch 120. The ledges 218 engage the bottom side 204 of the primary latch 120. Since the runners 214, 216 engage both the edge sides 230 and the bottom side 204, the runners 214, 216 effectively hook around the primary latch 120. Optionally, interior surfaces 232 of the runners 214, 216 that face the corresponding edge sides 230 of the latch 120 may be dovetailed with the edge sides 230. In an alternative embodiment, edge sides 230 of the latch 120 may define a slot, such as a T-shaped slot, that receives the ledges 218 of the runners 214, 216 therein to couple the runners 214, 216 to the primary latch 120. The engagement between the runners 214, 216 and the primary latch 120 allow the pivoting of the CPA lever 118 to lift and deflect the primary latch 120 when the CPA lever 118 is in the extended position.

Referring now to both FIGS. 3 and 4, when the rounded member 162 is moved by the mating connector 102 (shown in FIG. 1) during a mating operation from the seated position to the lifted position, the rounded member 162 engages the deflectable tab 210 of the CPA lever 118 and deflects the tab 210 vertically upwards to a clearance position that clears the protrusions 222. When the deflectable tab 210 is in the clearance position, the protrusions 222 do not block the deflectable tab 210 so the CPA lever 118 is able to be moved from the extended position to the retracted position. When the CPA lever 118 moves to the retracted position, the CPA lever 118 moves towards the front end 128 of the housing 110.

FIGS. 5-8 are cross-sectional views of the housing assembly 146 taken along line 5-5 shown in FIG. 3 at various stages of a mating operation according to an embodiment. FIGS. 5-8 illustrate how the movement of a male connector 102 (shown in FIG. 1) being loaded into the cavity 106 of the female connector 104 (FIG. 1) actuates the deflectable tab 210 of the CPA lever 118 via the rounded member 162 to release the CPA lever 118, providing connector position assurance. For example, the rounded member 162 does not attain the lifted position until the male connector 102 reaches the fully loaded position relative to the female housing 110. Since the rounded member 162 is only in the lifted position when the male connector 102 is fully loaded in the female housing 110, the CPA lever 118 is only released and movable from the extended position to the retracted position when the male connector 102 is fully loaded. Therefore, the ability to move the CPA lever 118 to the retracted position upon completion of a mating operation between a male connector 102 and a female connector 104 indicates that the connectors 102, 104 are fully and properly mated to each other. The retracted position of the CPA lever 118 represents an assurance position of the connector system 100 (shown in FIG. 1) because the state of the CPA lever 118 in the retracted position provides assurance that the connectors 102, 104 are fully and properly mated. The movement of the CPA lever 118 provides a sensory notification to the operator, such as a visual (seeing the CPA lever 118 in the locked position), tactile (feeling the CPA lever 118 move to the locked position), and/or audible (hearing the CPA lever 118 move to the locked position) indicator.

Figure 5:
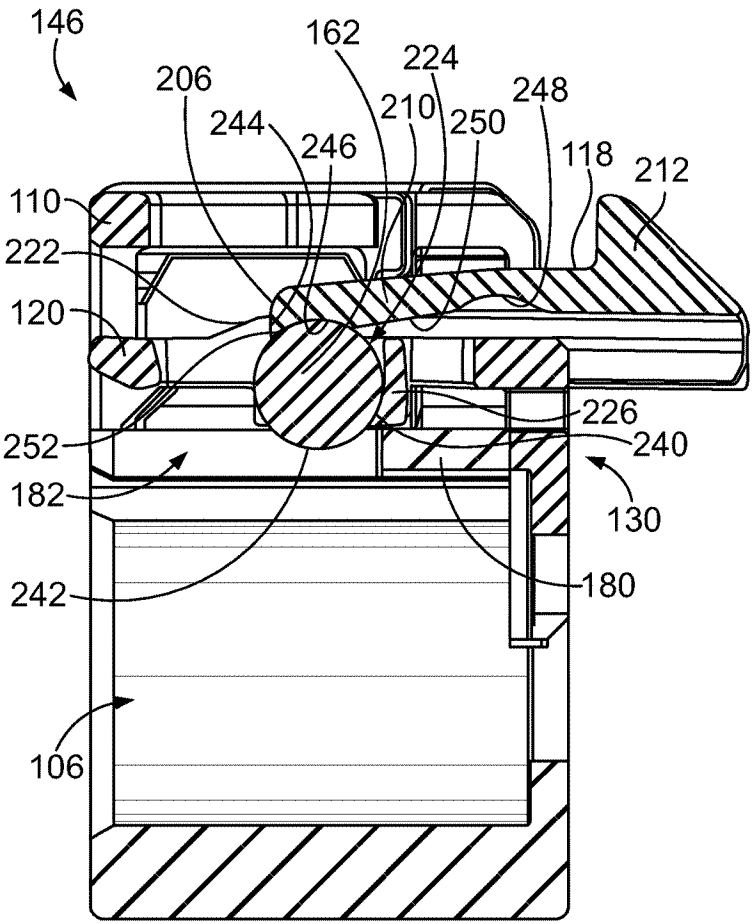
FIG. 5 is a cross-sectional view of the housing assembly in a pre-mated stage taken along line 5-5 shown in FIG. 3.

FIG. 5 is a cross-sectional view of the housing assembly 146 in a pre-mated stage according to an embodiment. The pre-mated stage indicates that the male housing 108 (shown in FIG. 6) of the male connector 102 (FIG. 1) is not fully mated to the female housing 110. In the illustrated embodiment, the male housing 108 is not received within the cavity 106 of the female housing 110. The rounded member 162 is in the seated position, resting on a bottom lip 240 of the collar 226. The lip 240 defines a smaller diameter than portions of the collar 226 above the lip 240. The diameter of the lip 240 may be smaller than a diameter of the rounded member 162, which prevents the rounded member 162 from falling downwards out of the socket 224. A lower portion 242 of the rounded member 162 extends at least partially into the channel 182 defined through the platform 180.

The CPA lever 118 is in the extended position. In the extended position, the base 212 of the lever 118 projects rearward beyond the rear end 130 of the housing 110. The CPA lever 118 projecting rearward of the housing 110 provides an indication that the connectors 102, 104 may not be fully mated. The CPA lever 118 is also configured to project rearward in order to provide leverage to reduce the pivot force necessary to deflect the primary latch 120. As shown in FIG. 5, the deflectable tab 210 is in a rest position, such that the deflectable tab 210 is currently not deflected by the rounded member 162 to a clearance position. When the deflectable tab 210 is in the rest position, the protrusion 222 is located in a path of the CPA lever 118 such that the distal end 206 of the deflectable tab 210 abuts against a hard stop surface 244 of the protrusion 222 to block attempted movement of the CPA lever 118 to the retracted position.

In an embodiment, the deflectable tab 210 defines a first concave detent 246 and a second concave detent 248 along a lower side 250 thereof that faces the primary latch 120. The first and second concave detents 246, 248 are spaced apart from each other along a length of the deflectable tab 210. The second concave detent 248 is located between the first concave detent 246 and the base 212 of the CPA lever 118. The detents 246, 248 are sized to receive an upper portion 252 of the rounded member 162 therein. As shown in FIG. 5, the rounded member 162 is received in the first concave detent 246 when the CPA lever 118 is in the extended position. The rounded member 162 is configured to be received in the second concave detent 248 when the CPA lever 118 is in the retracted position, as shown in FIG. 8. The concave detents 246, 248 are soft stops that provide sensory feedback to indicate whether the CPA lever 118 is in the extended position or the retracted position.

Figure 6:
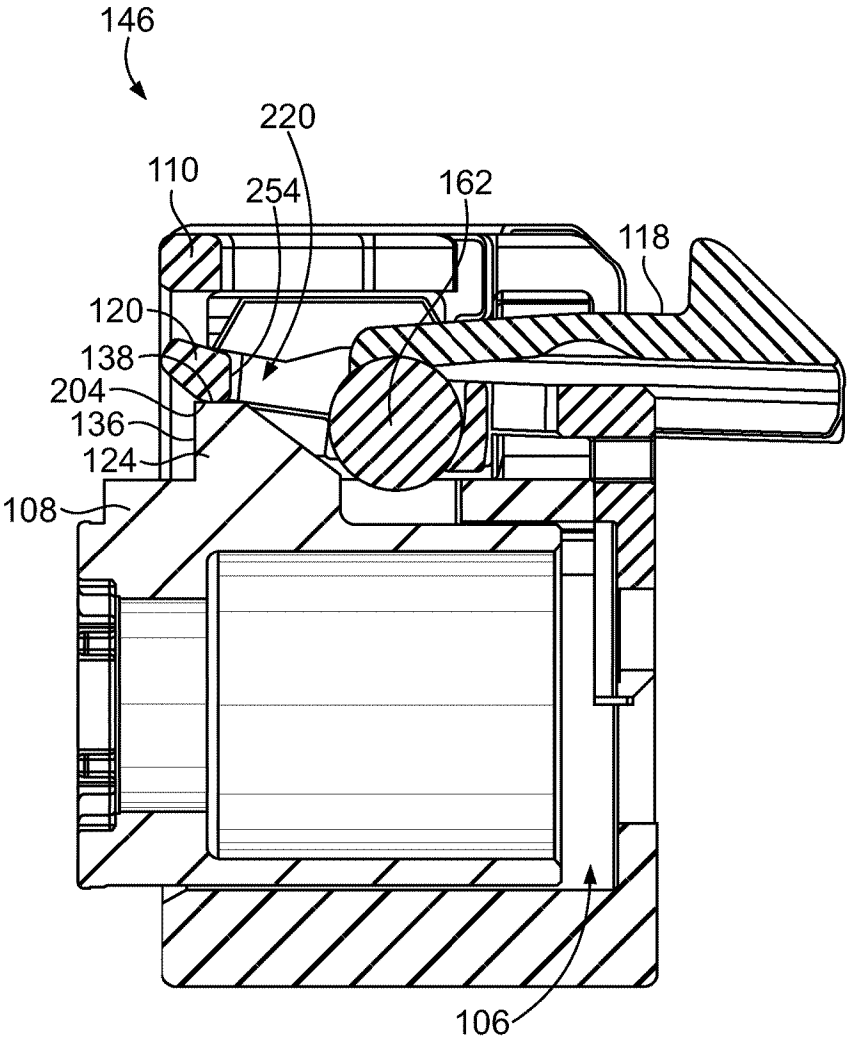
FIG. 6 is a cross-sectional view of the housing assembly in another pre-mated stage taken along line 5-5 shown in FIG. 3.

FIG. 6 is a cross-sectional view of the housing assembly 146 in another pre-mated stage according to an embodiment. FIG. 6 shows the male housing 108 being loaded into the cavity 106 prior to reaching the fully mated position. The rib 124 of the male housing 108 is engaged with the primary latch 120 and forces the latch 120 to deflect in a direction away from the cavity 106. Specifically, the top side 138 of the rib 124 engages the bottom side 204 of the primary latch 120 to lift and hold the primary latch 120 in a deflected state. The male housing 108 does not engage the rounded member 162 in FIG. 6, so the rounded member 162 remains in the seated position. Since the rounded member 162 is in the seated position, the CPA lever 118 is still restricted from moving to the retracted position.

In an embodiment, the primary latch 120 defines a latching surface 254 configured to engage the catch surface 136 of the rib 124 of the male housing 108 to secure the male housing 108 to the female housing 110. In the illustrated embodiment, the latching surface 254 is a rear-facing front wall of the aperture 220 defined through the primary latch 120. As shown in FIG. 6, the latching surface 254 of the primary latch 120 is not engaged with the catch surface 136, which indicates that the male housing 108 is not in the fully loaded position.

FIG. 7 is a cross-sectional view of a portion of the housing assembly 146 in an initial mated stage according to an embodiment. In FIG. 7, the male housing 108 is fully mated to the female housing 110. The latching surface 254 of the primary latch 120 is engaged with the catch surface 136 of the rib 124. The ramp 140 of the rib 124 is engaged with the rounded member 162 and supports the rounded member 162 in the lifted position. For example, the lower portion 242 of the rounded member 162 no longer projects below the collar 226, and the rounded member 162 is not resting on the lip 240 of the collar 226. Since the rounded member 162 has been lifted in an outward direction 256 away from the cavity 106 by the rib 124, the upper portion 252 of the rounded member 162 forces the deflectable tab 210 of the CPA lever 118 to deflect upwards as well. In an embodiment, the outward direction 256 is vertically upwards along the vertical axis 191 shown in FIG. 3. As shown in FIG. 7, the deflectable tab 210 is lifted to a clearance position that clears the protrusion 222. For example, the distal end 206 of the tab 210 is disposed vertically above the hard stop surface 244 of the protrusion 222. Thus, the protrusion 222 is not in the path of the deflectable tab 210. Although the CPA lever 118 is movable towards the retracted position, the CPA lever 118 remains in the extended position in FIG. 7. The CPA lever 118 is configured to be pushed in a stowing direction 260 to move the CPA lever 118 to the retracted position.

FIG. 8 is a cross-sectional view of a portion of the housing assembly 146 in a final mated stage according to an embodiment. The male housing 108 remains in the fully mated position, and the rounded member 162 remains supported by the rib 124 in the lifted position. The only difference from the initial mated stage shown in FIG. 7 is that the CPA lever 118 is in the retracted position relative to the housing 110. In the retracted position, the upper portion 252 of the rounded member 162 is received in the second concave detent 248. Moving the CPA lever 118 to the retracted position provides connector position assurance. Furthermore, the base 212 of the CPA lever 118 does not extend as far from the rear end 130 in the retracted position compared to the base 212 in the extended position. The base 212 optionally may not extend beyond the rear end 130 at all, such that the base 212 aligns between the front end 128 and the rear end 130. Thus, in the retracted position, the CPA lever 118 is stowed within the housing 110 and is less prone to interfering with cables and other electrical components attached to and/or near the housing assembly 146.

In order to subsequently disconnect the male housing 108 from the female housing 110, the CPA lever 118 is configured to be moved in an extending direction 262 that is generally opposite the stowing direction 260 (shown in FIG. 7). The CPA lever 118 may be moved in the extending direction 262 by engaging a front wall 264 of the base 212 and pushing or pulling the base 212 in the extending direction 262 with sufficient force to overcome the soft stop provided by the second concave detent 248. As shown in FIG. 4, at least one of the runners 214, 216 may have a retention ramp 266 that is configured to abut against a column of the frame 184 to prohibit the CPA lever 118 from being pulled too far in the extending direction 262 such that the CPA lever 118 uncouples from the housing 110.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing having a front end and defining a cavity at the front end that is configured to receive a mating connector therein, the housing further defining a socket adjacent to the cavity and at least partially open to the cavity, the housing including at least a first protrusion proximate to the socket that defines a hard stop surface;

a rounded member held in the socket of the housing and movable relative to the housing between a seated position and a lifted position, the rounded member biased towards the seated position and configured to be moved from the seated position to the lifted position by the mating connector as the mating connector is loaded into the cavity, the rounded member attaining the lifted position as the mating connector reaches a fully mated position in the cavity; and a connector position assurance (CPA) lever mounted on the housing and slidable relative to the housing between an extended position and a retracted position, the CPA lever including a base and a deflectable tab extending from the base, wherein, when the rounded member is in the seated position, movement of the CPA lever from the extended position to the retracted position is mechanically blocked by the hard stop surface of the first protrusion that abuts the deflectable tab, and wherein, when the rounded member is in the lifted position, the rounded member engages and deflects the deflectable tab to a clearance position that clears the first protrusion allowing the CPA lever to be moved from the extended position to the retracted position.

2. The electrical connector of claim 1, wherein the base of the CPA lever projects rearward beyond a rear end of the housing when the CPA lever is in the extended position, the base of the CPA lever being located more proximate to the front end of the housing when the CPA lever is in the retracted position than when the CPA lever is in the extended position.

3. The electrical connector of claim 1, wherein the housing further includes a deflectable primary latch that engages a catch of the mating connector when the mating connector is in the fully mated position to secure the mating connector to the housing, the CPA lever in the extended position being pivotable relative to the housing, the CPA lever being mounted to the primary latch such that pivoting movement of the CPA lever and lifts the primary latch in a direction away from the cavity to release the primary latch from the catch.

4. The electrical connector of claim 3, wherein the CPA lever includes first and second runners that extend from the base, the deflectable tab of the CPA lever extending along a top side of the primary latch, the first and second runners bordering corresponding edge sides of the primary latch, the first and second runners including at least one ledge that extends between the primary latch and the cavity and engages a bottom side of the primary latch to lift the primary latch when the CPA lever is pivoted.

5. The electrical connector of claim 1, wherein the rounded member is a spherical ball.

6. The electrical connector of claim 1, wherein the cavity of the housing is oriented along a mating axis such that the mating connector is loaded into the cavity along the mating axis, the CPA lever sliding parallel to the mating axis between the extended position and the retracted position, the rounded member moving generally transverse to the mating axis between the seated position and the lifted position.

7. The electrical connector of claim 1, wherein the deflectable tab of the CPA lever defines a first concave detent and a second concave detent that are spaced apart from each other along a length of the deflectable tab, the second concave detent being located between the first concave detent and the base of the CPA lever, the rounded member being received in the first concave detent when the CPA lever is in the extended position and being received in the second concave detent when the CPA lever is in the retracted position.

8. The electrical connector of claim 1, wherein the housing further includes a deflectable primary latch including a latching surface configured to engage a catch surface of a rib of the mating connector when the mating connector is in the fully mated position to secure the mating connector to the housing, the primary latch configured to be deflected in a direction away from the cavity by the rib of the mating connector as the mating connector is loaded into the cavity.

9. The electrical connector of claim 8, wherein the latching surface of the primary latch is located between the socket and the front end of the housing, the rounded member in the socket configured to be engaged and moved from the seated position to the lifted position by the rib of the mating connector, the rounded member being held in the lifted position by a top side of the rib as the catch surface of the rib engages the latching surface of the primary latch.

10. The electrical connector of claim 8, wherein the primary latch defines the socket and includes the first protrusion along a top side of the primary latch.

11. The electrical connector of claim 10, wherein the primary latch defines an aperture, the latching surface being a front wall of the aperture that faces a rear end of the housing, the socket being at least partially defined by a rear wall of the aperture that faces the front end of the housing.

12. The electrical connector of claim 1, wherein the housing defines a platform that has a top side and a bottom side, the bottom side at least partially defining the cavity, the CPA lever sliding along the top side of the platform, the platform defining a channel therethrough that is open to the cavity, the rounded member in the socket extending at least partially into the channel of the platform.

13. The electrical connector of claim 1, wherein the housing is defined by an upper housing member and a lower housing member that are coupled together, the lower housing member defining the cavity, the upper housing member defining the socket, the CPA lever being mounted to the upper housing member.

14. An electrical connector comprising:

a housing having a front end and defining a cavity at the front end that is configured to receive a mating connector therein, the housing further defining a socket adjacent to the cavity and at least partially open to the cavity, the housing including a deflectable primary latch that engages a catch of the mating connector when the mating connector is in a fully mated position in the cavity to secure the mating connector to the housing, the primary latch having at least a first protrusion that defines a hard stop surface;

a rounded member held in the socket of the housing and being movable relative to the housing between a seated position and a lifted position, the rounded member biased towards the seated position and configured to be moved from the seated position to the lifted position by the mating connector as the mating connector is loaded into the cavity, the rounded member attaining the lifted position as the mating connector reaches the fully mated position; and a connector position assurance (CPA) lever mounted on the primary latch and slidable relative to the primary latch between an extended position and a retracted position, the CPA lever including a base and a deflectable tab extending from the base, wherein, when the rounded member is in the seated position, movement of the CPA lever from the extended position to the retracted position is mechanically blocked by the hard stop surface of the first protrusion that abuts the deflectable tab, and wherein, when the rounded member is in the lifted position, the rounded member engages and deflects the deflectable tab to a clearance position that clears the first protrusion allowing the CPA lever to be moved from the extended position to the retracted position.

15. The electrical connector of claim 14, wherein the CPA lever in the extended position is pivotable relative to the housing, the CPA lever including first and second runners extending from the base, the first and second runners configured to engage a bottom side of the primary latch facing the cavity and lift the primary latch in a direction away from the cavity when the CPA lever is pivoted.

16. The electrical connector of claim 14, wherein the base of the CPA lever projects rearward beyond a rear end of the housing when the CPA lever is in the extended position, the base of the CPA lever aligning between the front end and the rear end of the housing when the CPA lever is in the retracted position.

17. The electrical connector of claim 14, wherein the cavity of the housing is oriented along a mating axis such that the mating connector is loaded into the cavity along the mating axis, the CPA lever sliding parallel to the mating axis between the extended position and the retracted position, the rounded member moving generally transverse to the mating axis between the seated position and the lifted position.

18. The electrical connector of claim 14, wherein the rounded member is a spherical ball.

19. The electrical connector of claim 14, wherein the deflectable tab of the CPA lever defines a first concave detent and a second concave detent that are spaced apart from each other along a length of the deflectable tab, the second concave detent being located between the first concave detent and the base of the CPA lever, the rounded member being received in the first concave detent when the CPA lever is in the extended position and being received in the second concave detent when the CPA lever is in the retracted position.

20. The electrical connector of claim 14, wherein the primary latch includes a latching surface that engages the catch of the mating connector, the primary latch defining the socket that holds the rounded member, the latching surface located between the socket and the front end of the housing.

* * * * *